US008594363B2

(12) United States Patent
Lee

(10) Patent No.: US 8,594,363 B2
(45) Date of Patent: Nov. 26, 2013

(54) VOICE COIL AND SMT MICRO SPEAKER USING THE SAME

(75) Inventor: Han-Ryang Lee, Gyeonggi-do (KR)

(73) Assignee: BSE Co., Ltd., Incheon (KR)

( * ) Notice: Subject to any disclaimer, the term of this patent is extended or adjusted under 35 U.S.C. 154(b) by 336 days.

(21) Appl. No.: 13/140,995

(22) PCT Filed: Dec. 8, 2009

(86) PCT No.: PCT/KR2009/007325

§ 371 (c)(1),
(2), (4) Date: Jun. 20, 2011

(87) PCT Pub. No.: WO2011/034256

PCT Pub. Date: Mar. 24, 2011

(65) Prior Publication Data

US 2011/0249859 A1 Oct. 13, 2011

(30) Foreign Application Priority Data

Sep. 15, 2009 (KR) ..... 10-2009-0086858

(51) Int. Cl.

| | |
|---|---|
| ***H04R 1/00*** | (2006.01) |
| ***H04R 9/06*** | (2006.01) |
| ***H04R 11/02*** | (2006.01) |
| ***H04R 9/04*** | (2006.01) |
| *H04R 9/02* | (2006.01) |

(52) U.S. Cl.
CPC ... *H04R 9/04* (2013.01); *H04R 9/02* (2013.01)
USPC ..... 381/400; 381/408

(58) Field of Classification Search
USPC ..... 381/150, 39, 400–410; 181/198, 199
See application file for complete search history.

(56) References Cited

U.S. PATENT DOCUMENTS

| | | | | |
|---|---|---|---|---|
| 5,701,358 | A * | 12/1997 | Larsen et al. | 381/423 |
| 6,404,896 | B1 * | 6/2002 | Yoo et al. | 381/401 |
| 2008/0310670 | A1 * | 12/2008 | Itakura | 381/412 |
| 2009/0285417 | A1 * | 11/2009 | Shin et al. | 381/151 |

FOREIGN PATENT DOCUMENTS

| | | | |
|---|---|---|---|
| JP | 57-048895 | A | 3/1982 |
| KR | 10-0185946 | B1 | 5/1999 |
| KR | 10-0453927 | B1 | 10/2004 |

(Continued)

OTHER PUBLICATIONS

International Search Report; mailed Oct. 18, 2010; Appln: PCT/KR2009/007325.

*Primary Examiner* — Tuan D Nguyen
(74) *Attorney, Agent, or Firm* — Ladas & Parry LLP

(57) ABSTRACT

A voice coil using a surface mount technology (SMT) to connect the voice coil and an electrode to each other, and a SMT speaker using the voice coil. A voice coil assembly includes a voice coil formed by stacking a plurality of laminated metal plates; and a flexible printed circuit board (FPCB) for impedance matching between the voice coil and an electrode terminal for connecting an external device and for connecting the voice coil to the electrode terminal. The laminated metal plates of the voice coil are connected in series or in parallel to each other. An active device is installed on the FPCB so as to amplify a signal input through the electrode terminal and to apply the signal to the voice coil. Since the voice coil is formed by stacking the laminated metal plates and is connected to the electrode terminal through the FPCB, a SMT is used to manufacture the SMT speaker, thereby improving productivity and reliability.

4 Claims, 4 Drawing Sheets

(56) References Cited

FOREIGN PATENT DOCUMENTS

| | | | |
|---|---|---|---|
| KR | 1020040085569 | A | 10/2004 |
| KR | 2005/055647 | A1 | 6/2005 |
| KR | 1020050055190 | A | 6/2005 |
| KR | 1020050082085 | A | 6/2005 |
| KR | 1020060017324 | A | 2/2006 |
| KR | 10-0576267 | B1 | 5/2006 |
| WO | 2005/055646 | A1 | 6/2005 |

* cited by examiner

VOICE COIL AND SMT MICRO SPEAKER USING THE SAME

CROSS-REFERENCE TO RELATED PATENT APPLICATION

This application claims the benefit of Korean Patent Applications No. 10-2009-0086858, filed on Sep. 15, 2009, in the Korean Intellectual Property Office, and the benefit of International Patent Application No. PCT/KR2009/007325, filed on Dec. 8, 2009, in the Korean Intellectual Property Office, the disclosures of which are incorporated herein in their entirety by reference.

BACKGROUND OF THE INVENTION

1. Field of the Invention

One or more aspects of the present invention relate to voice coils and micro speakers using the voice coils, and more particularly, to voice coils using a surface mount technology (SMT) for connection with an electrode and SMT micro speakers using the voice coils.

2. Description of the Related Art

A speaker is an audio device for generating a sound wave. The sound wave is generated as follows. In a magnetic circuit including a plate, a magnet and a yoke, a voice coil adhered to a diaphragm is positioned in a gap between the plate and the yoke. When an electrical signal flows through the voice coil, the electrical signal is converted into kinetic energy so that the diaphragm generates a compression wave, thereby generating the sound wave.

As shown in FIGS. 1 and 2, a conventional micro speaker 10 used in portable electrical products such as cellular phones includes a diaphragm 11 for generating a sound by using a vibration, a voice coil 12 that is adhered to the diaphragm 11 and vibrates the diaphragm 11 when a current flows through the voice coil 12, a frame 13 for supporting the diaphragm 11, a U-shaped yoke 14 installed on an inner portion of the frame 13, a magnet 15 and a plate 16 which are adhered to a central portion of the U-shaped yoke 14, and a cover 17. A power leader line 12*a* of the voice coil 12 is adhered to the diaphragm 11 by adhesives 18, and simultaneously, is connected to an external contact electrode by using a soldering method. Thus, the voice coil 12 may be connected to a printed circuit board (PCB) of an electrical device.

The diaphragm 11 of the conventional micro speaker 10 is formed of a synthetic resin to have a thickness from several microns to several tens of microns. When a current flows through the voice coil 12 disposed on a central portion of the diaphragm 11, a magnetic line of force is generated from the voice coil 12, and thus the magnetic line of force interacts with the magnet 15. Due to the interaction between the magnetic line of force and the magnet 15, the voice coil 12 vibrates up and down according to a direction and frequency of the current flowing through the voice coil 12, and the diaphragm 11 fixed to an upper portion of the voice coil 12 also moves up and down so as to output a sound.

A conventional speaker is manufactured using a manual operation involving positioning and shaping of leader lines and electrodes of voice coils, thereby causing environmental contamination and lowering productivity. In addition, a soldered portion between a contact electrode and a power leader line of a voice coil may come apart due to vibration of a diaphragm.

SUMMARY OF THE INVENTION

One or more aspects of the present invention provide voice coils that are connected to an electrode by using a surface mount technology (SMT) so as to increase productivity and reliability, and SMT micro speakers using the voice coils.

According to an aspect of the present invention, there is provided a voice coil assembly including a voice coil formed by stacking a plurality of laminated metal plates; and a flexible printed circuit board (FPCB) for impedance matching between the voice coil and an electrode terminal for connecting an external device and for connecting the voice coil to the electrode terminal. The plurality of laminated metal plates of the voice coil may be connected in series or in parallel to each other. In addition, an active device may be installed on the FPCB so as to amplify a signal input through the electrode terminal and to apply the signal to the voice coil. According to another aspect of the present invention, there is provided a SMT micro speaker including a diaphragm for generating a sound by using vibration; a voice coil that is formed by stacking a plurality of laminated metal plates and is adhered to the diaphragm so as to vibrate the diaphragm when a current is supplied to the diaphragm; a frame for supporting the diaphragm; a U-shaped yoke installed on an inner portion of the frame; a magnet adhered to a central portion of the U-shaped shape; a plate attached to the magnet; and a FPCB for connecting the voice coil and the electrode terminal to each other.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE INVENTION

The present invention will now be described more fully with reference to the accompanying drawings, in which exemplary embodiments of the invention are shown. The invention may, however, be embodied in many different forms and should not be construed as being limited to the embodiments set forth herein; rather, these embodiments are provided so that this disclosure will be thorough and complete, and will fully convey the concept of the invention to those of ordinary skill in the art.

Figure 1:
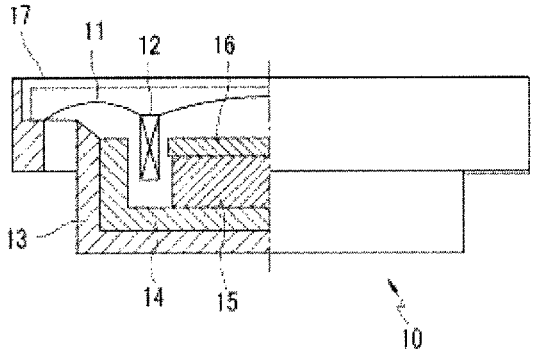
FIG. 1 is a schematic cross-sectional view of a conventional speaker.
Figure 2:
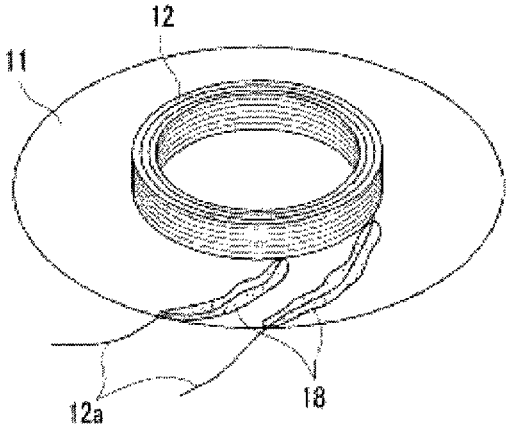
FIG. 2 is a perspective view of a diaphragm of the conventional speaker of FIG. 1.
Figure 3:
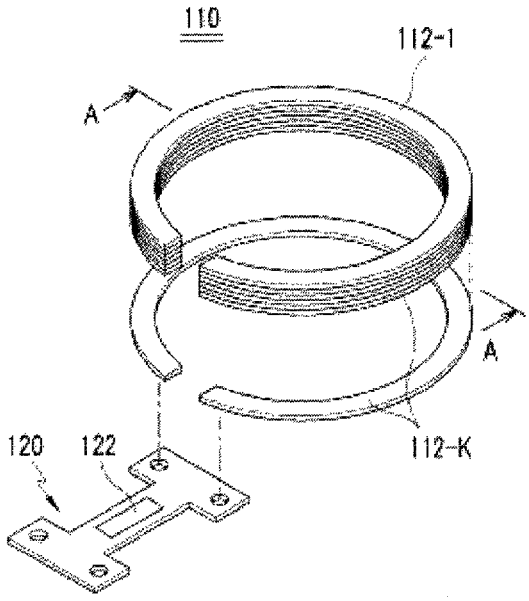
FIG. 3 is an exploded perspective view of a voice coil assembly including a voice coil according to an embodiment of the present invention.
Figure 4:
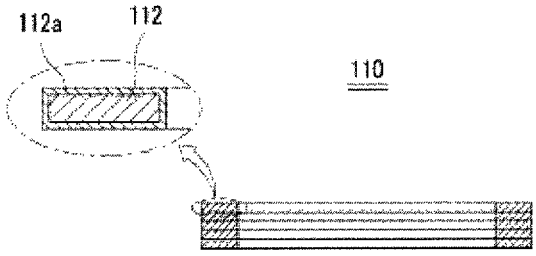
FIG. 4 is a cross-sectional view of a voice coil when the voice coil of FIG. 3 is assembled, according to an embodiment of the present invention.

FIG. 3 is an exploded perspective view of a voice coil assembly including a voice coil 110 according to an embodiment of the present invention. FIG. 4 is a cross-sectional view of the voice coil 110 when the voice coil 110 of FIG. 3 is assembled, according to an embodiment of the present invention.

As shown in FIG. 3, the voice coil assembly according to the present embodiment includes the voice coil 110 formed by stacking K ring-shaped laminated metal plates 1112-1 to 112-K, each of which having a portion removed to form a predetermined gap so as to be used in a cylindrical speaker structure, and a flexible printed circuit board (FPCB) 120 for connecting the voice coil 110 to a contact electrode (not shown). In this case, each of the ring-shaped laminated metal plates 1112-1 to 112-K may have a width from about 0.6 to about 0.8 mm and a gap of about 0.5 mm.

As shown in FIG. 4, each laminated metal plate 112 is laminated with an insulating material 112*a*, and is connected in series or in parallel to adjacent laminated metal plates 112-1 to 112-K to constitute a single circuit. In addition, the FPCB 120 includes an active device 122 for impedance matching. In this case, the active device 122 is installed in the FPCB 120 and connects the voice coil 110 to the contact electrode (not shown) so as to adaptively accept impedance characteristics required by an external device. In this case, an amplifier may be used as the active device 122.

Figure 5:
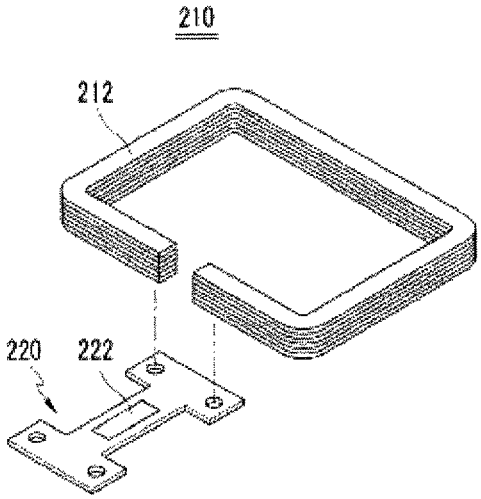
FIG. 5 is an exploded perspective view of a voice coil assembly including a voice coil according to another embodiment of the present invention

FIG. 5 is an exploded perspective view of a voice coil assembly including a voice coil 210 according to another embodiment of the present invention.

As shown in FIG. 5, the voice coil assembly according to the present embodiment includes K rectangular laminated metal plates 212-1 to 212-K, each of which having a portion removed to form a predetermined gap so as to be used in a rectangular speaker structure, and a FPCB 220 for connecting the voice coil 210 to a contact electrode (not shown).

Like in the voice coil 110 of FIG. 4, each of the rectangular laminated metal plates 212-1 to 212-K is laminated with an insulating material, and is connected in series or in parallel to adjacent laminated metal plates to constitute a single circuit. In addition, the FPCB 220 includes an active device 222 for impedance matching, which is installed in the FPCB 220 and connects the voice coil 210 to the contact electrode (not shown) so as to accept impedance characteristics required by an external device.

Figure 6:
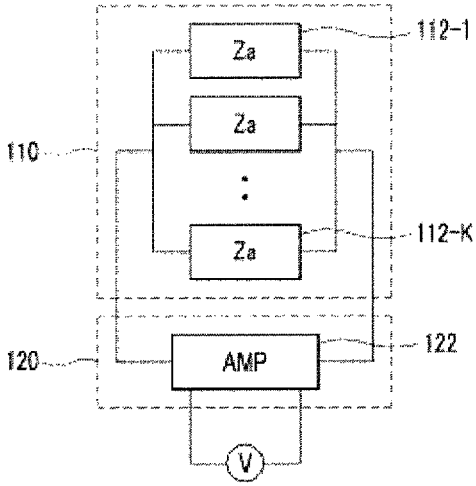
FIG. 6 is an equivalent circuit diagram of a case where laminated metal plates are connected in parallel to each other, according to an embodiment of the present invention.
Figure 7:
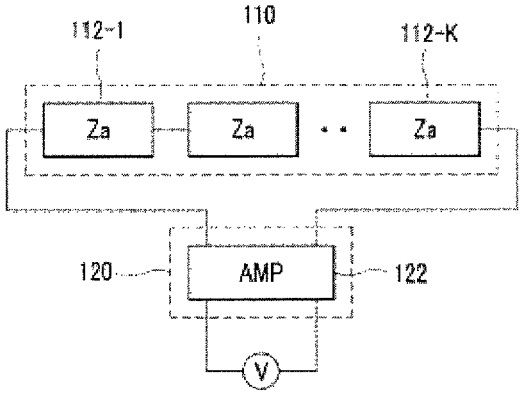
FIG. 7 is an equivalent circuit diagram of a case where laminated metal plates are connected in series to each other, according to another embodiment of the present invention.

According to one or more embodiments of the present invention, the laminated metal plates 112-1 to 112-K, or 212-1 to 212-K of the voice coil 110 or 210 are connected in series or in parallel to each other to form a single circuit. FIG. 6 is an equivalent circuit diagram of a case where the laminated metal plates 112-1 to 112-K of the voice coil 110 are connected in parallel to each other, according to an embodiment of the present invention. FIG. 7 is an equivalent circuit diagram of a case where the laminated metal plates 112-1 to 112-K of the voice coil 110 are connected in series to each other, according to another embodiment of the present invention.

Referring to FIG. 6 the laminated metal plates 112-1 to 112-K that are connected in parallel to each other are equivalent to impedances Z.sub.a that are connected in parallel to each other. A total impedance Z is obtained according to Equation 1. In this case, Z.sub.a is an impedance of each of the laminated metal plates 112-1 to 112-K.

$$\frac{1}{Z} = \frac{1}{Z_a} + \dots \frac{1}{Z_a} = \frac{K}{Z_a} \tag{1}$$

In addition, referring to FIG. 7, the laminated metal plates 112-1 to 112-K that are connected in series to each other are equivalent to impedances Z.sub.a that are connected in series to each other. A total impedance Z is obtained according to Equation 2.

$$Z=Z_a+Z_a \dots Z_a=KZ_a \tag{2}$$

Figure 8:
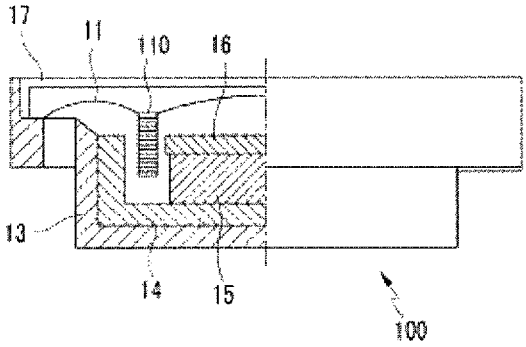
FIG. 8 is a schematic cross-sectional view of a micro speaker including a voice coil, according to an embodiment of the present invention

FIG. 8 is a schematic cross-sectional view of a micro speaker 100 including the voice coil 110, according to an embodiment of the present invention.

As shown in FIG. 8, the micro speaker 100 includes a diaphragm 11 for generating a sound by using vibration, the voice coil 110 that is formed by stacking laminated metal plates and is adhered to the diaphragm 11 so as to vibrate the diaphragm 11 when a current is supplied to the diaphragm 11, a frame 13 for supporting the diaphragm 11, a U-shaped yoke 14 installed on an inner portion of the frame 13, a magnet 15 and a plate 16 which are adhered to a central portion of the U-shaped yoke 14, and a cover 17. A laminated metal plate of the voice coil 110 is adhered to the diaphragm 11 by adhesives, and is connected to an external contact electrode through the FPCB 120 so that the micro speaker 100 may be connected to the a printed circuit board (PCB) of an electrical device.

When a current is supplied to the voice coil 110 installed on a central portion of a lower surface of the diaphragm 11 through the FPCB 120, a magnetic line of force is generated from the voice coil 110, and thus the magnetic line of force interacts with the magnet 15. Due to the interaction between the magnetic line of force and the magnet 15, the voice coil 110 vibrates up and down according to a direction and frequency of the current flowing through the voice coil 110, and the diaphragm 11 fixed to an upper portion of the voice coil 110 also moves up and down so as to output a sound.

In this case, although an impedance of the voice coil 110 including the laminated metal plate is lower than a conventional voice coil, the voice coil 110 may adaptively accept impedance characteristics required by an electrical device connected to the micro speaker 100 by using the active device 122 installed in the FPCB 120.

According to one or more embodiments of the present invention, a voice coil may be formed by stacking a plurality of laminated metal plates and may be connected to an electrode terminal through a FPCB. Thus, a surface mount technology (SMT) may be used to manufacture a speaker, thereby improving productivity and reliability.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A voice coil assembly comprising:

a voice coil formed by stacking a plurality of laminated metal plates; and a flexible printed circuit board (FPCB) for impedance matching between the voice coil and an electrode terminal for connecting an external device and for connecting the voice coil to the electrode terminal.

2. The voice coil assembly of claim 1, wherein the plurality of laminated metal plates of the voice coil are connected in series or in parallel to each other.

3. The voice coil assembly of claim 1, wherein an active device is installed on the FPCB so as to amplify a signal input through the electrode terminal and to apply the signal to the voice coil.

4. A surface mount technology (SMT) micro speaker comprising:

a diaphragm for generating a sound by using vibration;

a voice coil that is formed by stacking a plurality of laminated metal plates and is adhered to the diaphragm so as to vibrate the diaphragm when a current is supplied to the diaphragm;

a frame for supporting the diaphragm;

a U-shaped yoke installed on an inner portion of the frame;

a magnet adhered to a central portion of the U-shaped shape;

a plate attached to the magnet; and a flexible printed circuit board (FPCB) for connecting the voice coil and the electrode terminal to each other.

* * * * *